US008372335B2

(12) United States Patent
Claude et al.

(10) Patent No.: US 8,372,335 B2
(45) Date of Patent: Feb. 12, 2013

(54) AUSTENITIC DUCTILE CAST IRON

(75) Inventors: Antoine Claude, Dommartin-les-Remiremont (FR); Marc Wilson, Deyvillers (FR); Rayad Benchiheub, Fameck (FR); Lydie Tenet Schmitt, Thaon-les-Vosges (FR); Angelique Rouillon, Uxegney (FR)

(73) Assignee: Honeywell International Inc., Morristown, NJ (US)

( * ) Notice: Subject to any disclaimer, the term of this patent is extended or adjusted under 35 U.S.C. 154(b) by 201 days.

(21) Appl. No.: 12/687,505

(22) Filed: Jan. 14, 2010

(65) Prior Publication Data

US 2011/0171016 A1 Jul. 14, 2011

(51) Int. Cl.
*C22C 37/04* (2006.01)
*C22C 37/08* (2006.01)
*C22C 37/10* (2006.01)

(52) U.S. Cl. ..... 420/27; 420/17; 148/335; 148/336

(58) Field of Classification Search ..... 148/321–324, 148/328, 333–336; 420/9–33, 94–98, 104–118, 420/123, 129, 590, 591
See application file for complete search history.

(56) References Cited

U.S. PATENT DOCUMENTS

| | | | | |
|---|---|---|---|---|
| 2,326,730 | A | 8/1943 | Kelly et al. | |
| 2,485,760 | A * | 10/1949 | Millis et al. | 420/19 |
| 3,421,886 | A * | 1/1969 | Schelleng | 420/22 |
| 3,485,683 | A * | 12/1969 | Kies et al. | 148/503 |
| 4,528,045 | A | 7/1985 | Tanaka et al. | |
| 6,852,276 | B2 | 2/2005 | Kim | |
| 2003/0129073 | A1 | 7/2003 | Kim | |
| 2006/0191604 | A1 | 8/2006 | Itoh et al. | |
| 2008/0267808 | A1 | 10/2008 | Keil et al. | |

FOREIGN PATENT DOCUMENTS

| | | | |
|---|---|---|---|
| EP | 1 652 949 A1 | | 5/2006 |
| JP | 06-256890 | * | 9/1994 |
| WO | WO 2009/108181 A1 | | 9/2009 |

OTHER PUBLICATIONS

G.M. Goodrich, Introduction to Cast Irons: Graphite Morphologies, Casting, vol. 15, ASM Handbook, ASM International, 2008, 5 pages total.*

Glossary of Metallurgical and Metalworking Terms, ASM Handbook, ASM International, 2002, terms: cast iron, ductile iron.*

"Ductile Ni-Resist".

Covert et al., "Properties and Applications of Ni-Resist and Ductile Ni-Resist Alloys," 1998, pp. 1-14, 21.

Stefan, H., *Duktiles Gusseisen*, Schiele und Schon, Berlin, (1996), pp. 262, 263, 290-295.

*Properties and Applications of Ni-Resist and Ductile Ni-Resist Alloys*, Nickel Development Institute (NIDI) Reference Book, vol. 11.018, (1998), pp. 1-38.

European Search Report for Application No. 10 19 6676 dated Apr. 15, 2011.

* cited by examiner

*Primary Examiner* — Scott Kastler
*Assistant Examiner* — Vanessa Luk
(74) *Attorney, Agent, or Firm* — Alston & Bird LLP

(57) ABSTRACT

The invention provides an austenitic ductile cast iron alloy composition including about 2.2% to about 2.4% by weight carbon; about 3.5% to about 4.0% by weight silicon; about 28% to about 29% by weight nickel; about 2.5% to about 3.0% by weight chromium; about 0.9% to about 1.1% by weight molybdenum; and greater than about 50% iron, wherein percentages are based on the overall weight of the composition. The invention further provides articles, such as turbocharger housings, prepared using the inventive alloys.

19 Claims, 1 Drawing Sheet

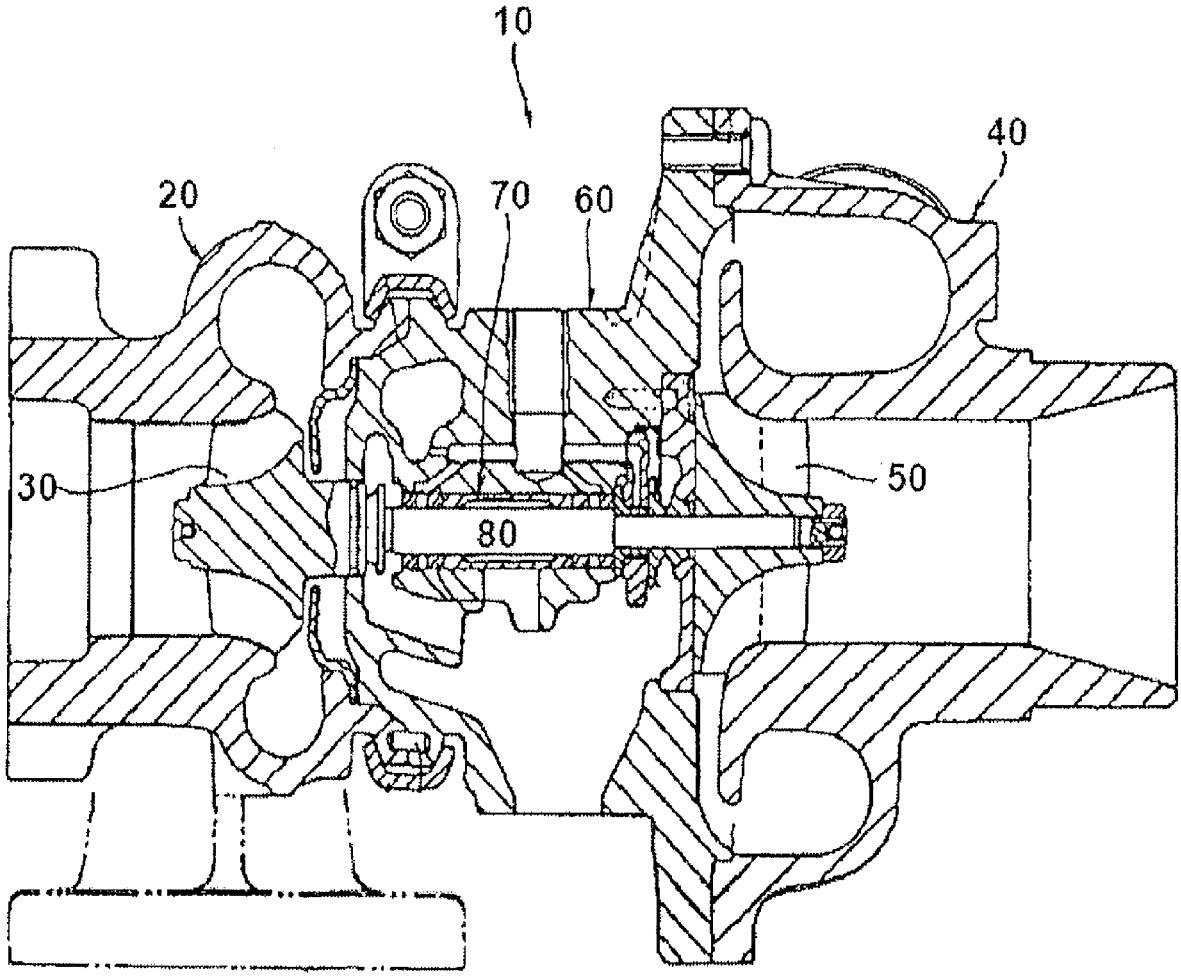
10
20
70
60
40
30
50
80

AUSTENITIC DUCTILE CAST IRON

FIELD OF THE INVENTION

The invention relates to alloy compositions useful in the preparation of articles for use in applications where high heat resistance is desired. The alloy compositions are particularly iron-based alloys.

BACKGROUND

Austenitic ductile irons are well known and have been used for many years in a wide range of applications requiring materials with specific chemical, mechanical, and physical properties. Ductile cast irons are cast irons containing graphite in the form of substantially spheroidal particles produced by suitable molten metal treatment. Spheroidal graphite has a polycrystalline radial structure. There are a number of different austenitic ductile iron types defined in the literature. The austenitic ductile iron types are defined based in part on their chemical makeup, comprising various amounts of iron, nickel, silicon, and carbon and, in some iron types, additional elements such as manganese, phosphorus, chromium, and molybdenum. These latter elements may be intentionally added or may be present as unavoidable impurities. The austenitic ductile iron types are further defined based on their varying levels of mechanical properties (i.e., tensile strength, yield stress, elongation, and Brinell hardness). In general, austenitic ductile irons typically display good corrosion, erosion, and wear resistance; good strength, ductility, and oxidation resistance at high temperatures; toughness and low temperature stability; controlled thermal expansion; controlled magnetic and electrical properties; and good castability and machinability. However, these qualities vary, depending on the type of austenitic ductile iron and accordingly, specific types are more useful than others in certain applications.

Austenitic ductile irons are commonly used in engine components such as exhaust manifolds, turbine housings, and other structural components that must operate under high thermal stress. Demand for improvements in fuel efficiency and reduction in exhaust gas from automobile engines has been satisfied by increasing engine power and combustion temperatures. These increases put a greater strain on structural engine components due to the increased temperature of exhaust gases that must pass through them. Specifically, the material used to construct the engine components must have high temperature resistance, good temperature fluctuation resistance, high scaling resistance, and low temperature expansion coefficient.

The increased temperatures at which engine components must operate has resulted in a more limited range of materials that can be used to construct such engine components. The austenitic ductile iron most commonly used to cast structural engine components is D-5S austenitic ductile iron. In particular, D-5S iron is commonly used in engine manifolds, turbine housings, and turbocharger components where high temperatures and severe thermal cycling occur. According to a widely accepted standard (ASTM A439), D-5S comprises 2.3% carbon, 1% manganese, 4.9-5.5% silicon, 1.75-2.25% chromium, 34-37% nickel, 0.08% phosphorus, with the balance iron. This alloy exhibits good elongation and yield strength at room temperature, good castability, and relatively good high temperature yield strength at exhaust gas temperatures up to about 900° C.

D-5S is highly alloyed, commonly comprising around 36% nickel. Nickel is an expensive raw material and suffers from a large fluctuation in price, which has become increasingly volatile. The high cost of nickel directly impacts the cost of the end product. Because the turbocharger housing and, in particular, the turbine housing of a turbocharger comprises the greatest weight, it also comprises the greatest cost of the entire turbocharger. Thus, the cost of the end product must be dramatically increased to account for the high cost of the nickel.

Accordingly, it would be beneficial to produce an alternative alloy for use in such structural components that is capable of withstanding the high temperatures required by modern engines, while minimizing the amount of nickel to keep costs low and more predictable.

SUMMARY OF THE INVENTION

The present invention provides alloy compositions useful for preparing articles having high performance properties, particularly high strength and heat resistance. The alloys of the invention are particularly useful in that they can be prepared using lower cost materials than presently known austenitic ductile cast irons. The inventive alloys disclosed herein are particularly austenitic ductile cast iron iron-based alloys that comprise a specific elemental make-up designed to retain the noted preferred properties but with a lowered preparation cost.

The alloys according to the present invention can be used in the preparation of any metallic article, but they are particularly useful in the preparation of material having high performance specifications, especially in relation to strength and heat resistance. One field where the alloys of the invention are especially beneficial is in the preparation of engine parts, such as turbine housings, exhaust manifolds, and exhaust manifolds integrally cast with turbocharger housings.

In one aspect, the invention is directed to a cast iron alloy composition, preferably an iron-based composition. In particular embodiments of the invention, only a few specific elements of the alloy composition need be present in specific amounts in order for the alloy composition to be useful in preparing articles having physical properties that are useful as described herein. For example, in one embodiment, an alloy composition according to the invention comprises: about 2.2% to about 2.4% by weight carbon; about 3.5% to about 4.0% by weight silicon; about 28% to about 29% by weight nickel; about 2.5% to about 3.0% by weight chromium; about 0.9% to about 1.1% by weight molybdenum; and greater than about 50% iron, wherein the alloy is substantially free of tin and antimony, the above weight percentages being based on the overall weight of the alloy composition.

According to further embodiments, the inventive alloy can comprise one or more additional elements. Specifically, an alloy according to the invention, in addition to the above elements, may comprise about 0.035% to about 0.090% by magnesium. In further embodiments, the alloy may comprise one or more optional trace elements including, but not limited to, up to about 0.10% manganese, up to about 0.08% phosphorus, and/or up to about 0.03% sulfur, all based on the overall weight of the composition. In additional embodiments, the alloy of the present invention may further comprise one or more other trace elements, each present in an amount up to about 0.03% by weight, with a total amount of trace elements up to about 0.5% by weight, more preferably up to about 0.25% by weight, and more preferably up to about 0.15% by weight, based on the overall weight of the composition.

In other embodiments of the invention, it is beneficial for the alloy composition of the invention to have a specifically defined composition. For example, in one specific embodiment, the invention is directed to a cast iron alloy composition consisting of about 2.2% to about 2.4% by weight carbon, about 3.5% to about 4.0% by weight silicon, about 28% to about 29% by weight nickel, about 2.5% to about 3.0% by weight chromium, about 0.9% to about 1.1% by weight molybdenum, about 0.035% to about 0.090% by weight magnesium, with the balance comprising iron and unavoidable impurities.

In preferred embodiments, the carbon equivalent of the alloy is within the range of about 4% to about 5%, preferably within the range of about 4.5% to about 4.8%, wherein the carbon equivalent is determined by the equation:

$$C_e = C_t + 0.33 \times Si + 0.047 \times Ni - 0.0055(Ni + Si);$$

where $C_e$ represents the carbon equivalent, $C_t$ represents the weight percentage of carbon in the alloy, Si represents the weight percentage of silicon in the alloy, and Ni represents the weight percentage of nickel in the alloy, and wherein percentages are based on the overall weight of the composition.

In some embodiments, the cast iron alloy of the invention has an austenitic structure with graphite that is essentially spheroidal, with a combined amount of Form I and II graphite according to ASTM A 247 at a level of about 80% or greater or at a level of about 85% or greater. In preferred embodiments, at least about 80% or at least about 85% of the combined amount of Form I and II graphite comprises Form I.

According to another aspect of the invention, the alloy composition described herein can be used in the preparation of a variety of articles. The alloy composition can be used in the preparation of any article commonly prepared from austenitic ductile iron alloys. The alloys of the invention are particularly useful for preparing articles for use in applications where the ability to support a high thermo-mechanical load is desired. In some embodiments, the invention relates to an exhaust equipment member for automobile engines prepared from an alloy of the invention. In one specific embodiment, the invention is directed to a turbine housing formed from an alloy composition as described herein.

As previously noted, articles that must support high thermo-mechanical loads, such as turbine housings, must be capable of meeting certain specific physical and mechanical requirements. Articles according to the present invention are particularly beneficial in that the articles are capable of meeting strict physical and mechanical requirements. Preferably, an article prepared using an alloy of the invention shows high mechanical qualities at temperatures up to around 950° C. gas temperature. In one embodiment, the invention provides an article having a specific strength when measured according to a specific testing procedure. Preferably, the article prepared using an alloy of the invention has an ultimate tensile strength at of at least about 300 MPa at room temperature, a 0.2% proof stress at room temperature of at least about 200 MPa, and a percent elongation of at least 5% when subjected to a continuous axial load at a constant strain rate of 0.05%/s while at room temperature.

BRIEF DESCRIPTION OF THE DRAWING

In order to assist the understanding of certain embodiments of the invention, reference will now be made to the appended drawings, which are not necessarily drawn to scale, and wherein:

THE FIGURE is a view of a turbocharger, item 20 being a turbine housing according to an embodiment of the invention.

DETAILED DESCRIPTION OF THE INVENTION

The present inventions now will be described more fully hereinafter with reference to specific embodiments of the invention and particularly to the various drawings provided herewith. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present invention is directed to austenitic ductile iron-based alloys. As such, the alloy compositions comprise iron as the major alloying element (or alloy component). Generally, as the major alloying element, iron is present in an amount greater than any other single element present in the alloy. Preferably, iron is present in an amount greater than the sum of the remaining alloying elements (i.e., comprising greater than 50% by weight of the alloy composition, based on the overall total weight of the composition). In a specific embodiment, iron comprises from about 50% by weight to about 65% by weight of the alloy composition of the invention. In another embodiment, iron comprises from about 60 to about 65% by weight of the alloy composition of the invention.

According to further embodiments of the invention, the alloy composition may be described in terms of consisting of a group of specific alloying elements in specific amounts. In such embodiments, the amount of iron present in the alloy can be referred to in terms of iron and unavoidable impurities forming the balance of the alloy. When described in such terms, it is understood that the balance being iron indicates that the actual concentration (in weight percent, based on the overall weight of the alloy) of iron present can be determined by obtaining the sum of the concentration of the other elements present and subtracting that sum from 100, the remainder representing the concentration of iron present in the alloy (i.e., the balance).

The alloy composition of the invention is particularly characterized in that alloy compositions provided herein can be used in the preparation of articles that meet or exceed mechanical and physical requirements necessary for high stress, high heat applications, yet the elemental makeup of the alloy compositions is such that the alloys can be prepared at a reduced cost in comparison to known, austenitic ductile irons. In certain embodiments, the alloy compositions of the invention achieve such characteristics in that the alloy comprises decreased amount of nickel relative to D-5S austenitic ductile iron, which is commonly used for such high stress, high-heat applications. The decreased amount of nickel in the alloy of the present invention relative to that of D-5S reduces the cost of production of the alloy, as nickel is expensive and is also a strategic material that suffers large fluctuations in price. In preferred embodiments, this decreased nickel content can be achieved without adversely affecting the physical properties of the alloy as compared to D-5S.

In particular embodiments, the alloy composition comprises nickel in an amount of about 10% to about 40% by weight, based on the overall weight of the alloy composition. In further embodiments, the alloy composition comprises nickel in an amount of about 25% to about 35%. In a preferred embodiment, the alloy composition comprises nickel in an amount from about 28% to about 30%. In a particularly preferred embodiment, the nickel content of the alloys of the present invention is from about 28% to about 29% by weight. Nickel helps to austenitize the matrix structure. When the content of Ni is less than about 10%, the austenite is not sufficiently stabilized. When the content of Ni exceeds 40%, no additional austenitizing effect is produced, leading only to an increase in material cost with no corresponding advantageous properties.

In addition to nickel and iron, the alloy compositions of the invention may contain one or more further alloying elements that may be useful for imparting beneficial properties to the alloy composition. Elements useful in certain preferred embodiments are described herein. Nevertheless, the inclusion of certain elements and the exclusion of certain further elements are not intended to limit the scope of the invention. Rather, the further elements described herein are only preferred, and further elements, as deemed beneficial, could be incorporated in the alloy without departing from the present invention. The amounts in which the further elements are included are based on the weight of the overall composition.

In particular embodiments, the alloy composition comprises carbon in an amount of about 1% to about 3% by weight, based on the overall weight of the alloy composition. In further embodiments, the alloy composition comprises carbon in an amount of about 1.5% to about 2.5% by weight. In preferred embodiments, carbon is present in an amount of from about 2.2% to about 2.4% by weight. The addition of carbon may result in the formation of graphite crystals and may improve the flowability of the material in melted form. When the carbon content is less than about 1%, spheroidal graphite cannot be crystallized and the flowability of the melt is not sufficient to effectively cast the materials. When the carbon content exceeds about 3.5%, coarse graphite particles are formed, resulting in spheroidal graphite cast iron with poor room temperature elongation and shrinkage cavities are likely to be formed during casting.

In particular embodiments, the alloy composition comprises chromium in an amount up to about 3% by weight, based on the overall weight of the alloy composition. In some embodiments, chromium is present in an amount of about 1% to about 3% by weight. In preferred embodiments, chromium is present in an amount from about 2.5% to about 3%. The chromium may help to precipitate carbides in a cast iron matrix, thereby improving the high-temperature yield strength of the spheroidal graphite cast iron by precipitation strengthening of the matrix. It may also form a dense, passive film of chromium oxide near the surface, thereby improving oxidation resistance. When the chromium content exceeds 3%, the workability of the material may be decreased, and the spheroidization of the graphite may be adversely affected. In some embodiments, the alloys of the present invention contain a higher amount of chromium than that in standard austenitic cast irons (e.g., D-5S) to ensure that the alloy displays high oxidation resistance. In specific embodiments, the alloys of the present invention may display better oxidation resistance than D-5S. In preferred embodiments, the alloys display better oxidation resistance than D-5S without detrimentally affecting the other material properties.

In particular embodiments, the alloy composition comprises molybdenum in an amount of about 0.5% to about 4.5% by weight, based on the overall weight of the alloy composition. In some embodiments, the alloy comprises molybdenum in an amount between about 0.5% and about 2% by weight. In further embodiments, the molybdenum content of the alloys is around 1% by weight. Preferably, the molybdenum content is between about 0.9% and about 1.1% by weight. Molybdenum may help to precipitate carbides in the cast iron matrix, and may thereby increasing the high-temperature yield strength of the spheroidal graphite cast iron matrix by precipitation strengthening throughout the entire range of temperatures at which the alloy may be used. When the molybdenum content is below 1% by weight, the matrix of the cast iron may not be subjected to sufficient precipitation strengthening by the formation of carbides. When the molybdenum content exceeds 4.5% by weight, the room temperature elongation and machinability may be decreased. Furthermore, molybdenum can be expensive and, accordingly, limiting the amount of molybdenum used may be desirable.

In particular embodiments, the alloy composition comprises silicon in an amount of about 1% to about 6.5% by weight. In some embodiments, the alloy comprises silicon in an amount of from about 3.5% to about 6% by weight. Preferably, the alloy comprises about 4.5% to about 6.0% by weight silicon. Silicon contributes to the crystallization of graphite. The inclusion of 1% or more by weight of silicon to the alloy may lead to the formation of a passive film of silicon oxide near the surface, resulting in improved oxidation resistance of the material. However, when the silicon content exceeds 6.5, a hard matrix is formed, which results in poor machinability of any article produced from the alloy.

In certain embodiments, the carbon equivalent value of the alloy may be specified. In preferred embodiments, the carbon equivalent value is calculated based on the following formula:

$$C_e = C_t + 0.33 \times Si + 0.047 \times Ni - 0.0055(Ni + Si);$$

where $C_e$ represents the carbon equivalent, $C_t$ represents the weight percentage of carbon in the alloy, Si represents the weight percentage of silicon in the alloy, and Ni represents the weight percentage of nickel in the alloy, based on the overall weight of the alloy composition.

In some embodiments, the carbon equivalent value of the alloy is between about 4% and about 5%, based on the overall weight of the alloy composition. In preferred embodiments, the carbon equivalent value is between about 4.5% and about 4.8%. The carbon equivalent value establishes the solidification temperature range of the alloy and is related to the foundry characteristics of the alloy and its properties. For example, in certain embodiments, higher concentrations of carbon and other elements such as nickel and silicon in the alloy may lead to increased hardness of an article produced therefrom. Each of these elements may influence the properties of the alloy to a somewhat different extent, making a method of comparison necessary to judge the differences in hardness between two alloys made of different alloying methods. Note that various amounts of silicon, nickel, and carbon may result in the same carbon equivalent value; alloys with the same carbon equivalent value do not necessarily have identical or similar properties. Accordingly, the use of carbon equivalent value to define an alloy may be helpful in predicting the properties of an alloy, but is somewhat limited.

According to a further embodiment, the alloy composition of the invention can comprise magnesium, which may be present in an amount ranging from about 0.02% to about 0.1% by weight, based on the overall weight of the alloy composition. Preferably, magnesium is present in an amount from about 0.035% to about 0.090%. In some embodiments, the magnesium may be added to the alloy melt as an inoculant, which may facilitate graphite nucleation and/or affect undercooling of the iron within the alloy. Inoculation may lead to improved machinability, increased strength and ductility, reduced hardness and section sensitivity, and a more homogeneous microstructure in the cooled alloy and any article prepared therefrom.

In addition to the above elements, in some embodiments, the alloy of the invention may comprise one or more elements present in trace amounts, and such elements may be referred to as trace elements. The term "trace element" as used herein means any element present in the alloy composition of the invention for which no minimum content is required. Trace elements, therefore, can be completely absent from the alloy composition. Trace elements may be present in the alloy as a direct result of the process used in preparing the alloy, or other elements may be intentionally included in the alloy composition, albeit in small amounts. If one or more trace elements is included in the alloy composition, it is preferably present at less than or equal to a maximum amount.

For example, in specific embodiments, the alloy of the invention may comprise one or more of manganese, phosphorus, sulfur and copper. In one embodiment, the alloy of the invention may comprise manganese. The manganese may be present in amount up to about 0.50% by weight, based on the overall weight of the alloy composition. In another embodiment, the alloy of the present invention may comprise phosphorus. The phosphorus may be present in an amount up to about 0.08% by weight, based on the overall weight of the alloy composition. For example, in a further embodiment, the alloy of the present invention may comprise sulfur. Sulfur may be present in an amount up to about 0.3% by weight, based on the overall weight of the alloy composition. In another embodiment, the alloy of the present invention may comprise copper. The copper may be present in an amount up to about 0.50% by weight, based on the overall weight of the alloy composition.

In additional embodiments, the alloy of the present invention may comprise other elements. In one embodiment, an individual trace element can be present in an amount up to about 1% by weight. More preferably, a trace element is present in an amount up to about 0.1% by weight. Trace elements preferably only comprise a minor percentage of the total alloy composition of the present invention. In certain embodiments, the sum of all trace elements present can comprise up to about 2% of the total weight of the overall alloy composition of the invention. Preferably, the sum of all trace elements comprises up to about 1.5% of the alloy by weight, and more preferably up to about 1% of the alloy by weight.

In certain embodiments, trace elements can be impurities. As common to alloying processes, particularly where lower cost materials are used in preparing the alloy, it is common for various impurities to be introduced into the alloy composition. Accordingly, any element present in the alloy composition that is not necessarily desired as an alloying element may be considered an impurity. Moreover, non-metallic materials, such as phosphorus, nitrogen, and oxygen, may be present as impurities. Of course, other non-metallic materials could also be included as impurities.

Elements that may particularly be present in trace amounts in the alloy composition of the present invention include, but are not limited to calcium and sodium. The amount of a single impurity is preferably no more than about 0.1%. In preferred embodiments, the combined amount of all impurities is below about 1%, preferably below about 0.5%, below about 0.4% or below about 0.3% by weight.

In certain embodiments, the alloys of the present invention are substantially free of tin and/or antimony. By substantially free is meant less than about 0.001% by weight of either element, more often less than about 0.0001%, and most often less than about 0.00001%. In certain embodiments, tin and antimony comprise essentially 0% by weight of the overall total alloy composition (i.e., the alloy composition is free of tin and antimony).

The advantages of the inventive alloy, particularly in relation to maintaining the overall strength associated with the alloy while reducing the overall cost of the alloy, can be achieved, in certain embodiments, by using specified amounts of these elements. In particular embodiments, the alloy composition comprises carbon in an amount ranging from about 2.2 to about 2.4%, silicon in an amount from about 3.5% to about 4%, nickel in an amount from about 28% to about 29%, chromium in an amount from about 2.5% to about 3%, and molybdenum in an amount from about 0.9% to about 1.1%, all percentages by weight and based on the total weight of the overall alloy composition. In other embodiments of the invention, it is beneficial for the alloy composition of the invention to have a specifically defined composition. For example, in one specific embodiment, the invention is directed to a cast iron alloy composition consisting of about 2.2% to about 2.4% by weight carbon, about 3.5% to about 4.0% by weight silicon, about 28% to about 29% by weight nickel, about 2.5% to about 3.0% by weight chromium, about 0.9% to about 1.1% by weight molybdenum, about 0.035% to about 0.090% by weight magnesium, with the balance comprising iron and unavoidable impurities.

The alloy compositions of the present invention are suitable for use in preparing a variety of articles by any methods generally known in the art. The alloy composition can be used in the preparation of any article commonly prepared from austenitic ductile iron alloys. The alloys of the invention are particularly useful for preparing articles for use in applications where the ability to support a high thermo-mechanical load is desired. In some embodiments, the invention relates to an exhaust equipment member for automobile engines prepared from an alloy of the invention. In one specific embodiment, the invention is directed to a turbocharger housing formed from an alloy composition as described herein. One embodiment of a turbocharger housing of the present invention is shown in FIG. 1. In particular, FIG. 1 illustrates a turbocharger 10, comprising a turbine housing 20, which houses a turbine wheel 30 as well as a compressor housing 40, which houses a compressor impeller 50 and a bearing housing 60 for housing a set of bearings. The set of bearings 70 supports a rotating shaft 80 that connects the turbine wheel 30 to the compressor impeller 50. In particular embodiments, one or more of the turbocharger 10, the turbine housing 20, the bearing housing 60 and the compressor housing 40 may comprise an alloy as described herein.

The alloys themselves may be prepared using any of the various traditional methods of metal production and forming. Traditional casting is the most common process for forming ingots of these alloys, although other methods may be used. Thermal and thermo-mechanical processing techniques common in the art for the formation of other alloys are suitable for use in manufacturing and strengthening the alloys of the present invention. Exemplary methods of preparing alloys and preparing articles made therefrom are provided in the following U.S. patents, which are incorporated herein by reference in their entirety: U.S. Pat. No. 4,608,094 to Miller et al., entitled Method of Producing Turbine Disks; U.S. Pat. No. 4,532,974 to Mills et al., entitled Component Casting; and U.S. Pat. No. 4,191,094 to Flippo, entitled Power Drive Unit.

In one particular embodiment, an alloy composition according to the present invention can be used in a sand casting technique to prepare articles, such as turbocharger housings. Sand casting is a process that provides casts with a good surface finish at low cost and with limited machining required afterwards. The mold is usually made of a material with a higher melting point than that of the alloy, such as a refractory aggregate or a high-temperature alloy. The mold may be made in one of a number of methods, depending on the specific alloy to be poured, the number of castings to be made, the dimensional requirements of the casting, and the property requirements of the casting. The metal comprising the alloy is melted and tapped from the melting furnace into a ladle for pouring into the mold cavity. Therein, the metal is left to solidify within the space defined by the mold and cores. Gates within the mold ensure that the liquid metal flows in to the mold cavity proper and risers help to control appropriate solidification. The casting is shaken out of the mold after it has solidified and the risers and gates are removed. If required, the casting may be heat treated. The casting is then cleaned and finished, and quality inspection is conducted. Of course, such a method could be altered to optimize the casting technique.

In some embodiments, the cast iron is treated after melting but before pouring into the mold to nodularize graphite. Nodularising is a process by which the microstructure and mechanical properties of cast iron can be improved. The nodularising process specifically impacts the microstructure of the material by ensuring graphite nodular growth. In ductile iron, the nodularising treatment will influence inoculation efficiency and, therefore, it is important to select the correct treatment process and magnesium bearing material. In certain embodiments, the formation of a high number of small micro-inclusions during magnesium treatment may be advantageous. During nodularising, numerous inclusions are formed with a sulphide core and an outer shell containing complex magnesium silicates. Such micro-inclusions will, however, not provide effective nucleation of graphite because the crystal lattice structure of magnesium silicates does not match well with the lattice structure of graphite. Accordingly, in some embodiments, the surface of the magnesium silicate particles may be inoculated with a ferrosilicon alloy containing calcium, barium, strontium, zirconium, aluminum, and/or a rare earth element. In such embodiments, the inoculation may modify the surface of the magnesium silicate particles and other complex calcium, barium, strontium, zirconium, aluminum, and/or rare earth element silicate layers may be produced. Such silicates may have the same hexagonal crystal lattice structure as graphite and, due to very good lattice mach, may therefore act as effective nucleation sites from which graphite nodules can grow during solidification.

In some embodiments, the cast iron is inoculated after melting but before pouring into the mold. Inoculation is a process by which the microstructure and mechanical properties of cast iron are improved to provide a final product with the desired mechanical properties. Inoculation may provide a casting with improved machinability, strength and ductility, reduced harness and section sensitivity, and a more homogeneous microstructure. It may also reduce the tendency for solidification shrinkage. The inoculation process specifically impacts the microstructure of the material by providing graphite nucleation sites (so that the dissolved carbon precipitates as graphite rather than iron carbides) and controlling the eutectic undercooling of the iron. Various inoculants may be used; in one embodiment, a ferrosilicon-based alloy with a small amount of calcium, barium, strontium, zirconium, aluminum, and/or a rare earth element is used. The inoculant may be added directly to the molten metal and may be added at various times during the process. For example, in some embodiments, the inoculant is introduced by simple ladle inoculation, injection into the pouring stream, and/or in-mold pellet. In some preferred embodiments, the inoculation is performed via addition to the pouring stream or in the mold. Preferably, when the inoculant is added to the mold, in-mold strainer cores may be used to minimize the presence of slag/oxide films and inclusions. The rate of addition of the inoculant will depend on where and when it is to be introduced. For example, if the inoculant is added early in the process (e.g., added to the transfer ladle), it may require a higher inoculant addition rate (e.g., as high as or exceeding about 1 wt %), whereas if it is added later in the process (e.g., added to the metal stream), it may require a lower inoculant addition rate (e.g., only about 0.1 wt % or less).

As indicated above, in preferred embodiments, the cast iron alloy has an austenitic structure. By austenitic structure is meant that the graphite is essentially spheroidal. Spheroidal refers to the presence of graphite particles in the form of small, round particles in a ductile matrix. Specifically, in preferred embodiments, the cast iron alloy of the invention has a microstructure comprising spheroidal graphite in a matrix of austenite. In some embodiments, the microstructure is evaluated by preparing the samples by standard metallographic techniques and etched. The determination of the form and count of the graphite characteristics may be carried out using either an image analysis system according to PI-5993 or in comparing microscopic examination with, for example, ASTM A 247 charts.

There are a range of forms of graphite forms, which may be defined according to ASTM standards, ranging from Form I (fully spheroidal) to Form III and IV (compacted/vermicular and spiky graphite). The microstructure may not be homogeneous throughout the article, and may vary within different portions of the article.

In some embodiments, the cast iron alloy of the invention has an austenitic structure with graphite that is essentially spheroidal. In preferred embodiments, the alloy has a combined amount of Form I and II graphite according to ASTM A 247 at a level of at least about 80% or greater, based on the total graphite weight. In particularly preferred embodiments, Form I is predominant. In specific embodiments, at least about 80% of the combined amount of Form I and II graphite may comprise Form I and in preferred embodiments, at least about 87% of the combined amount of Form I and II graphite may comprise Form I. Embodiments, wherein the percentage of Form I and II graphite is at least about 80%, and wherein at least about 80% or 87% of that Form I and II graphite is Form I graphite, may be particularly preferred for light sections of an article prepared from the alloy compositions disclosed herein (e.g., within the containment band, volute walls, and manifold tubes). In some embodiments, the remaining graphite, comprising up to about 20% of the total graphite, may comprise Form III and IV graphite. In preferred embodiments, Form III predominates within this Form III and IV graphite. In particularly preferred embodiments, the alloy comprises no Form V and VI graphite.

In other embodiments, the cast iron alloy of the invention has an austenitic structure with graphite that is essentially spheroidal, with a combined amount of Form I and II graphite according to ASTM A 247 at a level of at least about 70% or greater, based on the total graphite weight. In particularly preferred embodiments, Form I is predominant. In specific embodiments, at least about 70% of the combined amount of Form I and II graphite may comprise Form I. These embodiments, wherein the percentage of Form I and II graphite is at least about 70%, wherein at least about 50% of that Form I and II graphite is Form I graphite, may be particularly preferred for heavier sections of an article prepared from the alloy compositions disclosed herein (e.g., within the flanges, tongue region, contour of wastegated housings, and below the "U" surface of VNT housings). In some embodiments, the remaining graphite, comprising up to about 30% of the total graphite, may comprise Form III and IV graphite. In preferred embodiments, Form III predominates within this Form III and IV graphite. In particularly preferred embodiments, the alloy comprises no Form V and VI graphite.

In some embodiments of the present invention, the alloy may further comprise Form VII (flake/lamellar) graphite or quasi-flake graphite (Form IV). In preferred embodiments, if the alloy contains Form VII and/or IV graphite, it is present at a cast surface or surface reaction zone. Preferably, where present, the Form VII and/or IV graphite is present to a maximum depth of about 0.2 mm in thin walls and about 0.4 mm in thick walls. By "thin wall" is meant a wall that is less than or equal to about 5 mm thick, and by "thick wall" is meant a wall that is greater than about 5 mm thick.

In some embodiments of the present invention, the graphite nodule count is specified. For example, in some embodiments, the material may exhibit a nodule count from about 100 to about 500 $mm^2$. In some embodiments, the material may exhibit a nodule count of about 200 to about 500 $mm^2$ in thin walls of the castings. In some embodiments, the material may exhibit a nodule count of about 150 to about 450 $mm^2$ in thick walls of the castings. The graphite nodule count may be performed, for example, using a comparative count method or suitable image analysis equipment. In preferred embodiments, all graphite items with a diameter of less than about 10 μm are not considered in this count. In preferred embodiments, the count is done on a picture at a magnification of 100×.

In some embodiments of the present invention, the average diameter of the graphite nodules is specified. For example, in some embodiments, the material comprises graphite nodules with an average diameter in the range of about 10 μm to about 50 μm, preferably in the range of about 10 μm to about 40 μm.

In some embodiments of the present invention, the matrix structure of the alloy is specified. For example, in some embodiments, the matrix structure of a fully annealed casting after being etched with a reagent such as Nital 5% (comprising about 5 mL of chlorhydric acid diluted in about 100 mL of ethanol), may be essentially ferritic. In some embodiments, the matrix may contain up to about 25% of mixed carbides and pearlite at the original austenite grain boundaries. In preferred embodiments, the matrix does not contain a network of continuous carbide. In particularly preferred embodiments, where mixed carbides are present, the content of coarse carbides is limited to less than about 5% of the mixed carbide content.

In some embodiments of the present invention, the extent and form of porosity may be specified. Porosity may be present in clustered form, uniformly dispersed, or exhibiting directionality in alignment with dendrite growth. Porosity may be detected by sectioning, grinding, and polishing. In preferred embodiments, the porosity is minimized.

Articles prepared using certain embodiments of the inventive alloy composition described herein would particularly be expected to meet or exceed increased performance requirement for use in high temperature applications. As illustrated in the Examples, certain embodiments of the alloy composition of the invention provide for the preparation of articles having mechanical properties (such as ultimate tensile strength, yield strength, and elongation), that exemplify excellent performance at increased temperatures.

In certain embodiments, alloys of the present invention may display high mechanical properties at temperatures up to about 800° C., up to about 850° C., up to about 900° C., up to about 950° C., or up to about 1000° C., wherein the temperature refers to the gas temperature to which the article is subjected. Preferably, alloys of the invention display high mechanical properties at temperatures up to about 950° C., wherein the temperature refers to the gas temperature to which the article is subjected. Accordingly, articles prepared using certain embodiments of the alloy composition of the invention would be expected to find beneficial use in high temperature applications and provide not only increased performance but also prolonged life of the article under high temperature conditions.

In one embodiment, articles prepared using the alloy of the present invention are particularly capable of meeting or exceeding various standards for specific physical or mechanical properties. In some embodiments, mechanical properties are measured in accordance with ASTM E8 or another equivalent national standard on test bars. Preferably, a tensile sample is removed from the casting sample for testing. Where this is not possible, even with the smallest sample test dimension described in ASTM E8, the specimens for testing may be machined from keel blocks or Y-blocks that followed the same production process as the parts they are intended to represent. Ideally, the cooling conditions of the blocks after casting is similar to that of the castings, and the wall thickness of the blocs should be representative of the thickest section of the casting. In some embodiments, wherein keel blocks or Y-blocks are used for testing, a minimum of three tensile tests are performed.

For example, in one embodiment, articles display a tensile strength of at least about 340 MPa, at least about 360 MPa, at least about 380 MPa, at least about 400 MPa, or at least about 420 MPa at room temperature. In preferred embodiments, articles display a tensile strength of at least about 380 MPa. In some embodiments, articles display a 0.2% proof stress of at least about 190 MPa, at least about 200 MPa, at least about 210 MPa, at least about 220 MPa, or at least about 230 MPa. In preferred embodiments, articles display a 0.2% proof stress of at least about 210 MPa. In some embodiments, articles display an elongation of at least about 5%, at least about 8%, at least about 10%, at least about 12%, or at least about 15%. In preferred embodiments, articles display an elongation of at least about 10%.

In certain embodiments, the alloys of the present invention may display yield strengths as tested per ASTM E8M ranging from about 200 MPa to about 250 MPa at 25° C. In some embodiments, the yield strength is at least about 220 or about 230 MPa at 25° C. In certain embodiments, the alloys of the present invention may display yield strengths as tested per ASTM E8M ranging from about 60 Mpa to about 100 MPa at 1000° C. In some embodiments, the yield strength is at least about 70, at least about 80, or at least about 90 MPa at 1000° C. In some embodiments, the yield strengths of an alloy of the present invention are greater than those of D-5S at one or more of room temperature and elevated temperatures (up to and/or exceeding about 1000° C.). In certain embodiments, the alloys of the present invention may display ultimate tensile strengths as tested per ASTM E8M ranging from about 350 MPa to about 450 MPa at 25° C. In certain embodiments, the alloys of the present invention may display ultimate tensile strengths as tested per ASTM E8M ranging from about 60 MPa to about 100 MPa at 1000° C. In some embodiments, the ultimate tensile strength is at least about 70, at least about 80, or at least about 90 MPa at 1000° C. In some embodiments, the ultimate tensile strength of an alloy of the present invention is greater than that of D-5S, particularly at temperatures above about 600° C. In certain embodiments, the alloys of the present invention may display a Youngs modulus ranging from about 100 GPa to about 150 GPa at 25° C. In certain embodiments, the alloys of the present invention may display a Youngs modulus ranging from about 50 GPa to about 70 GPa at 1000° C.

In certain embodiments, the alloys of the present invention may exhibit fatigue/failure after a total number of cycles ranging from about 10,000 to about 11,000 at 500° C. with a total strain of 0.5%, ranging from about 15,000 to about 16,000 at 600° C. with a total strain of 0.5%, and ranging from about 8,000 to about 9,000 at 700° C. with a total strain of 0.5%. In some embodiments, the alloys may exhibit failure after more than about 7,500, more than about 10,000, or more than about 10,500 cycles at 500° C. with a total strain of 0.5%, more than about 10,000, more than about 12,500, or more than about 15,000 cycles at 600° C. with a total strain of 0.5%, and/or more than about 7,000, more than about 7,500, or more than about 8,000 at 700° C. with a total strain of 0.5%. In certain embodiments, the alloys of the present invention exhibit failure after a greater number of cycles than D-5S.

In one embodiment, an article prepared using the alloy of the invention has a specific hardness lower than about 300 HBW 5/750 at room temperature, such as when evaluated according to testing method EN ISO 6506-1 (performed on a machined surface or after light grinding (≈0.5 mm) of the cast surface).

In some embodiments, the determination of the graphite characteristics (form and count) is conducted, for example, by comparing microscope examination with ASTM A 247 charts.

EXAMPLES

The present invention is more fully illustrated by the following examples, which are set forth to illustrate the present invention and are not to be construed as limiting.

Various methods are available for chemical analysis of castings, such as emission spectroscopy, inductively coupled plasma glow discharge luminescence and wet chemistry. During the production process, samples taken from furnace or ladle for process control purposes are likely to be special chilled samples suitable for very rapid analysis by emission spectroscopy. There can be variation in response to a particular analytical technique if the iron is chilled (white) or graphitic (as in the finished casting). In some embodiments, accuracy of the analytical technique is particularly important for silicon, and silicon analysis is typically conducted on finished castings using a wet/gravimetric technique, although other available techniques may be used.

Studies were carried out by tests on gas stands and engines for different temperatures ranges to allow for ready comparison between the alloys of the present invention and D-5S per EN 13835. The tested exemplary alloy and the tested D-5S alloy are set forth in Table 1. These tests simulated the turbine housing material behavior during the service life. Different turbine housings were subjected to application of appropriate thermal cycling and wastegate operation for 200 hours. Tests were conducted with the maximum temperature being 950° C. The turbine stage components were subjected to accelerated running conditions, which simulate the actual environmental conditions a turbocharger would be expected to endure.

The turbine stage was visually inspected and the material cracks and imperfections were reviewed periodically during the test duration. After testing, metallurgical inspection of the components was conducted. Following this post-test analysis of the components, it was concluded that the present invention could be used interchangeably with the austenitic ductile iron D-5S presently used for such applications.

Example 1

Alloy Formulation

TABLE 1

| Alloy Formulation | | |
|---|---|---|
| Element | Inventive Alloy (D-3.5) | D-5S |
| C | 2.29 | 1.76 |
| Ni | 28.01 | 34.01 |
| Cr | 2.52 | 2.09 |
| Si | 3.85 | 5.18 |
| Mo | 0.88 | 0.033 |
| Mn | 0.12 | 0.26 |
| Mg | 0.066 | 0.057 |
| P | 0.013 | 0.038 |
| S | 0.005 | 0.003 |
| Cu | 0.03 | 0.03 |

Example 2

Representative Tensile Testing, Conducted at High Strain Rate of 1%/s as per ASTM E8M 2004 (Published May 2004)

TABLE 2

| | Temperature (° C.) | | | | | | | |
|---|---|---|---|---|---|---|---|---|
| | 25 | 100 | 500 | 600 | 700 | 800 | 900 | 1000 |
| Yield Strength Re (Mpa) | | | | | | | | |
| D-5S | 217.9 | 188.2 | 168.8 | 161.7 | 157.2 | 164.2 | 102.4 | 59.5 |
| D-3.5 | 240.0 | 214.2 | 200.3 | 193.8 | 181.8 | 182.6 | 133.1 | 91.3 |
| Ultimate Tensile Strength Rm (Mpa) | | | | | | | | |
| D-5S | 440.7 | 383.6 | 366.7 | 334.8 | 279.5 | 177.1 | 103.3 | 61.0 |
| D-3.5 | 387.9 | 357.9 | 356.9 | 302.7 | 291.3 | 206.1 | 148.0 | 91.6 |
| Young Modulus E (Gpa) | | | | | | | | |
| D-5S | 141.3 | 128.2 | 90.0 | 76.9 | 67.7 | 85.3 | 51.1 | 67.1 |
| D-3.5 | 127.7 | 120.8 | 91.9 | 101.8 | 99.7 | 66.5 | 73.7 | 64.3 |

Example 3

Representative Fatigue Testing, Conducted as per ASTM E606 1992 (Published March 1993)

TABLE 3

| Strain Controlled Low Cycle Fatigue Testing (High Strain Rate Testing (1%/s) with R Ratio of −1) (Total strain amplitude is given above) | | | | | | |
|---|---|---|---|---|---|---|
| | Temperature (° C.) | | | | | |
| | 500 | | 600 | | 700 | |
| D-5S | 0.5 | 1.5 | 0.4 | 1.5 | 0.4 | 1.5 |
| | 5700 | 260 | 10070 | 190 | 6570 | 220 |
| D-3.5 | 0.5 | 1.5 | 0.4 | 1.5 | 0.4 | 1.5 |
| | 10705 | 140 | 15600 | 70 | 8230 | 70 |

Note that the columns under each temperature in the table above indicate two different total strain rates. For example, the first cell 500/0.5/D5S, with a value of 5,700 indicates that a low cycle fatigue test conducted at 500° C. with a total strain of 0.5% (which is for a maximum strain of 0.25% at an R ratio of −1, so a minimum strain of −0.25%) resulted in a failure after 5,700 cycles.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An austenitic ductile cast iron alloy composition comprising:

about 2.2% to about 2.4% by weight carbon;
about 3.5% to about 6.0% by weight silicon;
about 28% to about 29% by weight nickel;
about 2.5% to about 3.0% by weight chromium;
about 0.9% to about 1.1% by weight molybdenum;
less than about 0.0001% by weight tin and antimony; and
greater than about 50% iron,
wherein percentages are based on the overall weight of the composition, and
wherein the cast iron has an austenitic structure having graphite that is essentially spheroidal, with a combined amount of Form I and II graphite according to ASTM A 247 at a level of about 70% or greater based on total graphite weight, and at least about 87% of the combined amount of Form I and II graphite comprises Form I, according to ASTM A 247 and based on total graphite weight.

2. The cast iron alloy composition of claim 1, further comprising about 0.035% to about 0.090% by weight magnesium, based on the overall weight of the composition.

3. The alloy composition of claim 1, further comprising one or more trace elements.

4. The alloy composition of claim 3, wherein said one or more trace elements comprise one or more of the following:

up to about 0.10% manganese;
up to about 0.08% phosphorus; and
up to about 0.03% sulfur;
based on the overall weight of the composition.

5. The alloy composition of claim 3, wherein said one or more trace elements is each present in an amount up to about 0.1% by weight, based on the overall weight of the composition.

6. The alloy composition of claim 3, wherein said one or more trace elements are present in a total amount up to about 0.15% by weight, based on the overall weight of the composition.

7. A turbine housing or turbine manifold formed from an alloy composition according to claim 1.

8. The turbine housing or turbine manifold of claim 7, wherein said turbine housing or turbine manifold, has an ultimate tensile strength at of at least about 380 MPa at room temperature when measured according to ASTM E8.

9. The turbine housing or turbine manifold of claim 7, wherein said turbine housing or turbine manifold has a 0.2% proof stress at room temperature of at least about 210 MPa when measured according to ASTM E8.

10. The turbine housing or turbine manifold of claim 7, wherein said turbine housing or turbine manifold exhibits a percent elongation of at least about 10% at rupture at room temperature when measured according to ASTM E8.

11. The turbine housing or turbine manifold of claim 7, wherein said turbine housing or turbine manifold has a hardness at room temperature of less than about 300 HBW 5/750, wherein the hardness is measured in conformance with EN ISO 6506-1.

12. An austenitic ductile cast iron alloy composition consisting of:

about 2.2% to about 2.4% by weight carbon;
about 3.5% to about 6.0% by weight silicon;
about 28% to about 29% by weight nickel;
about 2.5% to about 3.0% by weight chromium;
about 0.9% to about 1.1% by weight molybdenum;
about 0.035% to about 0.090% by weight magnesium;
less than about 0.0001% by weight tin and antimony; and
balance iron and unavoidable impurities,
wherein percentages are based on the overall weight of the composition.

13. The cast iron alloy composition of claim 12, wherein the cast iron has an austenitic structure having graphite that is essentially spheroidal with a combined level of Form I and II according to ASTM A 247 at a level of about 70% or greater based on total graphite weight.

14. The cast iron alloy composition of claim 13, wherein the Form I and II graphite comprises at least about 70% graphite with Form I according to ASTM A 247 and based on total graphite weight.

15. A turbine housing or turbine manifold formed from an alloy composition according to claim 12.

16. The turbine housing or turbine manifold of claim 15, wherein said turbine housing or turbine manifold has an ultimate tensile strength at room temperature of at least about 380 MPa when measured according to ASTM E8.

17. The turbine housing or turbine manifold of claim 15, wherein turbine housing or turbine manifold has a 0.2% proof stress at room temperature of at least about 210 MPa when measured according to ASTM E8.

18. The turbine housing or turbine manifold of claim 15, wherein said turbine housing or turbine manifold exhibits a percent elongation of at least 10% at failure at room temperature when measured according to ASTM E8.

19. The turbine housing or turbine manifold of claim 15, wherein said turbine housing or turbine manifold has a hardness at room temperature of less than about 300 HBW 5/750, wherein the hardness is measured in conformance with EN ISO 6506-1.

* * * * *